US009165727B2

(12) United States Patent
Tan et al.

(10) Patent No.: US 9,165,727 B2
(45) Date of Patent: Oct. 20, 2015

(54) POWER-DOWN ELECTRICAL LOCKING PROTECTION DEVICE FOR UNDERGROUND EXPLOSION PROTECTION FREQUENCY CONVERTER

(71) Applicant: CHINA MINING DRIVES & AUTOMATION CO., LTD., Xuzhou, Jiangsu (CN)

(72) Inventors: Guojun Tan, Jiangsu (CN); Jiaxing Chen, Jiangsu (CN); Liang Yang, Jiangsu (CN)

(73) Assignee: CHINA MINING DRIVES & AUTOMATION CO., LTD. (CN)

( * ) Notice: Subject to any disclaimer, the term of this patent is extended or adjusted under 35 U.S.C. 154(b) by 0 days.

(21) Appl. No.: 14/007,251

(22) PCT Filed: Oct. 15, 2012

(86) PCT No.: PCT/CN2012/082944

§ 371 (c)(1),
(2) Date: Sep. 24, 2013

(87) PCT Pub. No.: WO2013/064012

PCT Pub. Date: May 10, 2013

(65) Prior Publication Data

US 2014/0224625 A1 Aug. 14, 2014

(30) Foreign Application Priority Data

Nov. 1, 2011 (CN) ..... 2011 1 0339775

(51) Int. Cl.
*H01H 9/00* (2006.01)
*H01H 9/22* (2006.01)
*H01H 9/04* (2006.01)

(52) U.S. Cl.
CPC ..... *H01H 9/226* (2013.01); *H01H 9/045* (2013.01)

(58) Field of Classification Search
CPC ..... H01H 9/045; H01H 9/226
See application file for complete search history.

(56) References Cited

U.S. PATENT DOCUMENTS

| | | | | |
|---|---|---|---|---|
| 6,082,433 | A * | 7/2000 | Vafaie et al. | 160/310 |
| 6,425,820 | B1 * | 7/2002 | Kennedy et al. | 454/169 |
| 8,375,948 | B2 * | 2/2013 | Turiello | 128/205.26 |
| 8,381,726 | B2 * | 2/2013 | Turiello | 128/205.26 |
| 8,643,225 | B2 * | 2/2014 | Scharnick | 307/326 |
| 8,688,247 | B2 * | 4/2014 | Scharnick | 700/79 |

FOREIGN PATENT DOCUMENTS

CN 202544895 U * 11/2012 ..... E21F 1/10

OTHER PUBLICATIONS

PCT International Search Report issued in corresponding application No. PCT/CN2012/082944, dated Jan. 31, 2013 (4 pgs).

* cited by examiner

*Primary Examiner* — Robert J Hoffberg
(74) *Attorney, Agent, or Firm* — Hayes Soloway P.C.

(57) ABSTRACT

A power-down electrical locking protection device for an underground explosion protection frequency converter comprises a reversing control part and a locking control part. The reversing control part comprises a reversing handle (1), a sector plate (2) of a reversing switch, and an isolated reversing switch (3). The locking control part comprises a locking button (4), a locking positioning plate (5), and an auxiliary control point (6). The reversing handle (1) is fixedly connected to the sector plate (2). The reversing handle (1) is connected to the isolated reversing switch (3). The locking button (4) is fixedly connected to the locking positioning plate (5). The locking button (4) is connected to the auxiliary control point (6). A positioning stud (7) is fixed outside a cupboard door (8). The locking button (4) is electrically connected to a PLC module and a power supply. The isolated reversing switch (3) is connected to a discharge resistor. The power-down electrical locking protection device for an underground explosion protection frequency converter has the following advantages: the discharge time does not need to be calculated manually and the usage is stable and safe.

4 Claims, 2 Drawing Sheets

POWER-DOWN ELECTRICAL LOCKING PROTECTION DEVICE FOR UNDERGROUND EXPLOSION PROTECTION FREQUENCY CONVERTER

FIELD OF THE INVENTION

The present invention relates to a product of locking protection device, in particular to a power-down electrical locking protection device for underground explosion-proof converter cabinet, and belongs to the technical field of locking protection devices.

BACKGROUND OF THE INVENTION

Converters bring low-loss and high-performance characteristics to electric driving applications. However, ordinary converters cannot be used in coal mines, where the atmosphere has high gas concentration and high humidity. In recent years, a variety of explosion-proof converters applicable to mines were developed in China and foreign countries. For these converter products, safety is especially important because these converters are applied in working environments with high gas concentration.

The application of such converters involves a cover opening process after converters being powered off. Most existing converter products employ a pure mechanical locking structure and require manual calculation of safe discharge time and manual control of the cover opening process. Those kinds of products all have instability factors in terms of safety level and device control, which have impact on stability and reliability of the product to some degree.

DISCLOSURE OF THE INVENTION

Technical Problem

The application of such converters involves a cover opening process after converters being powered off. Most existing converter products employ a pure mechanical locking structure and require manual calculation of safe discharge time and manual control of the cover opening process. Those kinds of products all have instability factors in terms of safety level and device control, which have impact on stability and reliability of the product to some degree.

SOLUTION TO THE PROBLEM

Technical Solution

In view of the above problems in the prior art, the present invention provides a power-down electrical locking protection device for underground explosion-proof converter cabinet, which does not require manual calculation of discharge time and attains technical effects of stable and safe operation and good response rate.

To attain the object described above, the present invention employs the following technical scheme: a power-down electrical locking protection device for underground explosion-proof converter, comprising a steering control part and a locking control part, wherein, the steering control part comprises a steering lever, a sector plate for steering switch, and an isolated steering switch; the locking control part comprises a locking button, a locking positioning plate, and auxiliary control point; the steering lever is fixedly connected to the sector plate, the steering lever is connected to the isolated steering switch, the locking button is fixedly connected to the locking positioning plate, the locking button is connected to the auxiliary control point, and a positioning stud is fixed to the outside of the cabinet door; the steering control part is connected to the locking part by means of shape-position fitting between the sector plate for steering switch and the locking positioning plate; the locking button is electrically connected to a PLC module and a power supply, and the isolated steering switch is connected with discharge resistors.

The steering lever is fixedly connected to the sector plate by welding.

The steering lever is connected to the isolated steering switch by means of connecting bolts.

The locking button is fixedly connected to the locking positioning plate by welding.

BENEFICIAL EFFECTS OF THE INVENTION

Beneficial Effects

The present invention has the following beneficial effects: the locking positioning plate can be disengaged from the sector plate for steering switch by pressing down the locking button; then, the positioning stud can be moved to open or close the front door by turning the steering lever and adjusting the angle; therefore, the locking protection device provided in the present invention does not require manual calculation of discharge time, and attains technical effects of stable and safe operation and good response rate.

BRIEF DESCRIPTION OF THE DRAWINGS

Description of the Drawings

Figure 1:
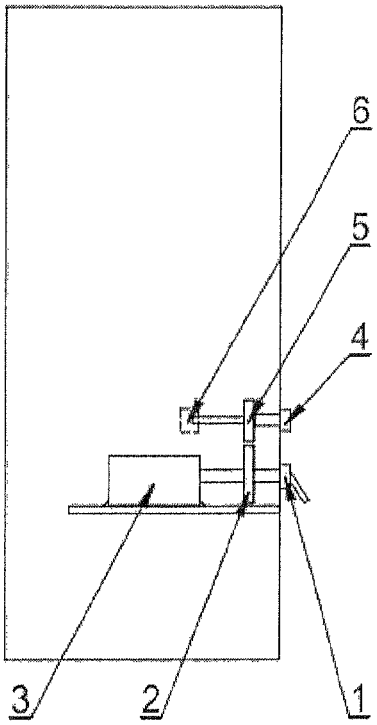
Figure 2:
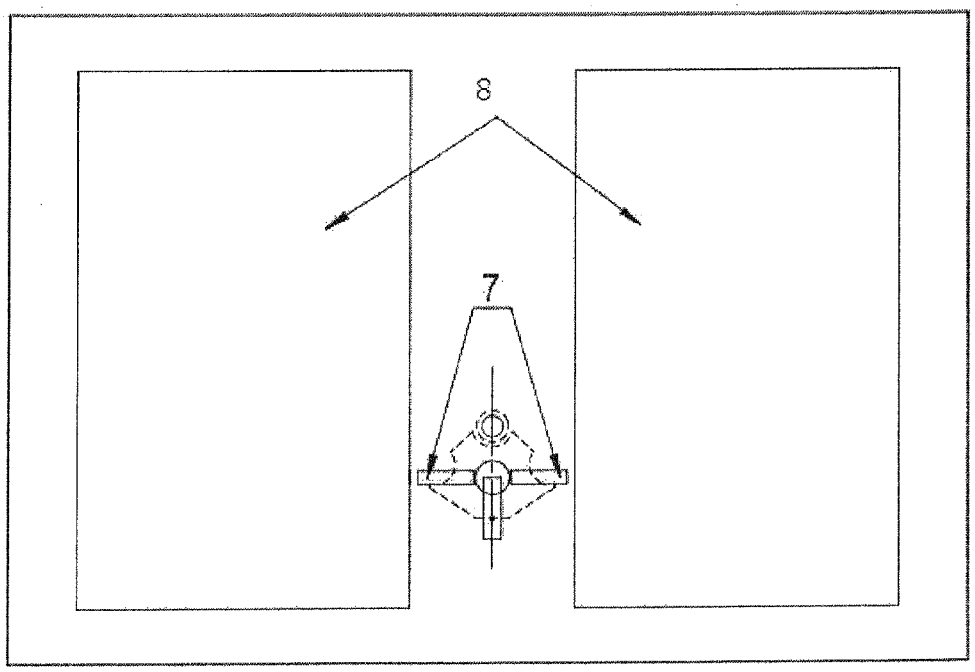
Figure 3:
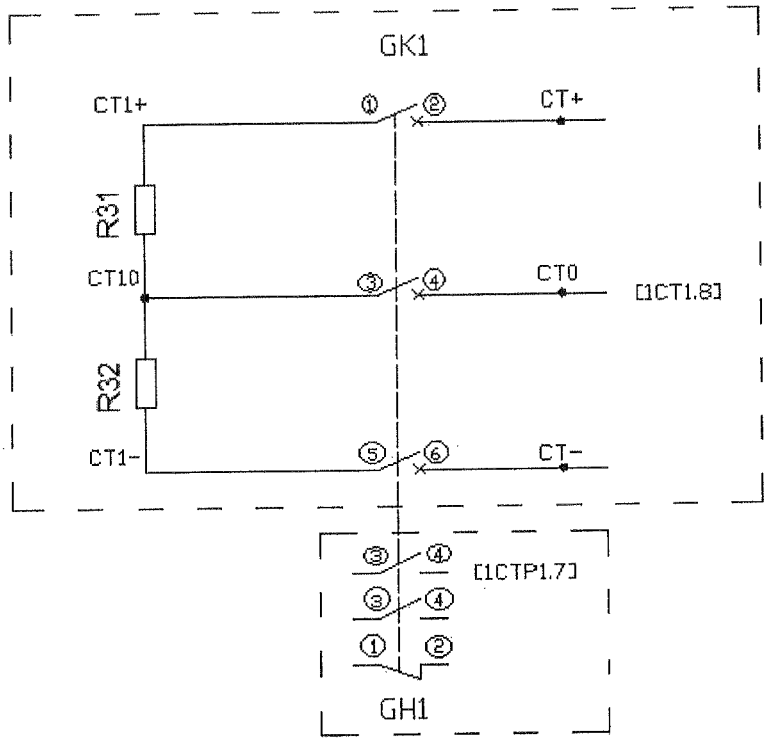

FIG. 1 is a schematic structural diagram of the present invention;

FIG. 2 is an external view of the present invention;

FIG. 3 is a circuit diagram of the present invention.

Among the drawings: 1—steering lever, 2—sector plate for steering switch, 3—isolated steering switch, 4—locking button, 5—locking positioning plate, 6—auxiliary control point, 7—positioning stud, 8—cabinet door

PREFERRED EMBODIMENTS OF THE INVENTION

Detailed Description of the Embodiments

Hereunder the present invention will be detailed, with reference to the drawings.

As shown in FIGS. 1, 2 and 3, the present invention comprises a steering control part and a locking control part, wherein, the steering control part comprises a steering lever 1, a sector plate 2 for steering switch, and an isolated steering switch 3; the locking control part comprises a locking button 4, a locking positioning plate 5, and auxiliary control point 6; the steering lever 1 is fixedly connected to the sector plate 2, the steering lever 1 is connected to the isolated steering switch 3, the locking button 4 is fixedly connected to the locking positioning plate 5, the locking button 4 is connected to the auxiliary control point 6, and a positioning stud 7 is fixed to the outside of the cabinet doors 8; the steering control part is connected to the locking control part by means of shape-position fitting between the sector plate 2 for steering switch and the locking positioning plate 5; the locking button 4 is electrically connected to a PLC module and a power supply, and the isolated steering switch 3 is connected with discharge resistors; the steering lever 1 is fixedly connected to the sector plate 2 by welding; the steering lever 1 is connected to the isolated steering switch 3 by means of connecting bolts; the locking button 4 is fixedly connected to the locking positioning plate 5 by welding.

The mechanical manipulation process of the present invention is as follows: the locking positioning plate 5 is disengaged from the sector plate 2 for steering switch by pressing down the locking button 4; then, the positioning stud 7 can be moved to open or close the front door by turning the steering lever 1 and adjusting the angle.

The electrical circuit switch-on process is as follows: press down the button GH1, so that the normally open auxiliary points ③ and ④ are closed or the normally closed auxiliary points ① and ② are opened, so as to send a signal to the superior power supply and input a binary signal into the PLC module; then, turn the isolated steering switch GK1 to a specific angle, so that the contacts ①~⑥ of GK1 are closed and the electrical circuit is switched on.

The electrical circuit switch-off process is as follows: press down the button GH1, so that the normally open auxiliary points ③ and ④ are closed or the normally closed auxiliary points ① and ② are opened, so as to send a signal to the superior power supply and input a binary signal into the PLC module; then, turn the isolated steering switch GK1 to the initial angle, so that the contacts ①~⑥ of GK1 are opened and the electrical circuit is switched off.

The working process of the locking protection device involves two states:

ON state to OFF state of the system: press down the locking button 4 (GH1), so that the normally open auxiliary points ③ and ④ are closed or the normally closed auxiliary points ① and ② are opened, so as to send an OFF signal to the superior power supply and input a binary signal into the PLC module; at this time, the locking positioning plate 5 is disengaged from the sector plate 2 for steering switch; then, turn the isolated steering switch 3 (GK1) to a specific angle (i.e., a positioning hole on the steering lever 1 aligns to the positioning stud 7), so that the contacts ①~⑥ of GK1 are closed, and the electrical circuits CT+, CT0, CT− are connected to the discharge resistors R31 and R32; after several seconds, the system discharges completely, and then turn the positioning stud 7 and open the cabinet door safely.

OFF state to ON state of the system: press down the locking button 4 (GH1), so that the normally open auxiliary points ③ and ④ are closed or the normally closed auxiliary points ① and ② are opened, so as to send an ON signal to the superior power supply and input a binary signal into the PLC module; at this time, the locking positioning plate 5 is disengaged from the sector plate 2 for steering switch; then, turn the isolated steering switch 3 (GK1) to the initial angle, so that the contacts ①~⑥ of GK1 are opened, and the electrical circuits CT+, CT0, CT− are disconnected from the discharge resistors R31 and R32, and the cabinet door can be closed. In that process, if the isolated steering switch 3 is not turned to the accurate position, the contacts ①~⑥ of GK1 cannot be opened, and the system cannot be switched on; that phenomenon indicates the cabinet door is not closed tightly.

During the system operation process in charged state, the contacts ①~⑥ of GK1 are always in open state.

The invention claimed is:

1. A power-down electrical locking protection device for underground explosion-proof converter, comprising a steering control part and a locking control part, wherein, the steering control part comprises a steering lever (1), a sector plate (2) for steering switch, and an isolated steering switch (3); the locking control part comprises a locking button (4), a locking positioning plate (5), and auxiliary control point (6); the steering lever (1) is fixedly connected to the sector plate (2), the steering lever (1) is connected to the isolated steering switch (3), the locking button (4) is fixedly connected to the locking positioning plate (5), the locking button (4) is connected to the auxiliary control points (6), and a positioning stud (7) is fixed to the outside of cabinet doors (8); the steering control part is connected to the locking control part by means of shape-position fitting between the sector plate (2) for steering switch and the locking positioning plate (5); the locking button (4) is electrically connected to a PLC module and a power supply, and the isolated steering switch (3) is connected with discharge resistors.

2. The power-down electrical locking protection device for underground explosion-proof converter according to claim 1, wherein, the steering lever (1) is fixedly connected to the sector plate (2) by welding.

3. The power-down electrical locking protection device for underground explosion-proof converter according to claim 1, wherein, the steering lever (1) is connected to the isolated steering switch (3) by means of connecting bolts.

4. The power-down electrical locking protection device for underground explosion-proof converter according to claim 1, wherein, the locking button (4) is fixedly connected to the locking positioning plate (5) by welding.

* * * * *